United States Patent [19]

Anderson et al.

[11] 4,416,293

[45] Nov. 22, 1983

[54] METHOD AND APPARATUS FOR RECORDING GAIT ANALYSIS IN PODIATRIC DIAGNOSIS AND TREATMENT

[76] Inventors: Blair V. Anderson, 1695 Lakeside Dr., Reno, Nev. 89509; Morris Feldman, 528 "B" St., Santa Rosa, Calif. 95403; Richard Jacoby, Phoenix, Ariz. 85001

[21] Appl. No.: 245,319

[22] Filed: Mar. 19, 1981

[51] Int. Cl.[3] ..... A61B 5/10

[52] U.S. Cl. ..... 128/782; 128/779; 73/172; 272/69

[58] Field of Search ..... 128/779, 782, 774, 1 R, 128/733; 73/172, 151; 272/69, 96

[56] References Cited

U.S. PATENT DOCUMENTS

| | | | |
|---|---|---|---|
| 2,087,584 | 7/1937 | Staudinger | 128/779 X |
| 3,332,683 | 7/1967 | Rand | 272/69 X |
| 3,675,640 | 7/1972 | Gatts | 272/69 X |
| 3,752,144 | 8/1973 | Weigle, Jr. | 128/774 |
| 3,894,437 | 7/1975 | Hagy et al. | 128/779 X |
| 4,122,840 | 10/1978 | Tsuchiya et al. | 128/779 |
| 4,267,728 | 5/1981 | Manley et al. | 128/779 X |
| 4,278,095 | 7/1981 | Lapeyre | 272/69 X |

OTHER PUBLICATIONS

"Computers and the Kinesiology of Gait"; Kasvand et al; Apr., 1976; Comput. Biol. and Med.; vol. 6, No. 2; pp. 111–120.

"The Design and Construction of a New Apparatus for Measuring the Vertical Forces Exerted in Walking: A Gait Machine"; Skorecki; Journal of Strain Analysis; vol. 1, No. 5; 1966; pp. 429–438.

"The Measurement and Display of Foot/Ground Forces During Gait"; Proceedings of 7th New Eng. Bioeng. Conf.; N.Y.; 1979; pp. 523–526.

Phillips et al.; Motor-Driven Treadmill for Studying in Cats", *Amer. Journal of Phys. Med.;* vol. 56, No. 1, 1977, pp. 12–20.

*Primary Examiner*—Lee S. Cohen

*Assistant Examiner*—Angela D. Sykes

*Attorney, Agent, or Firm*—Herbert C. Schulze

[57] ABSTRACT

This invention is a method and apparatus for practicing the method in which data may be uniquely recorded concerning the gait of a patient undergoing diagnosis and/or treatment in connection with podiatric matters. The method includes a special video recording and sound recording of the movement and effects of movement of the patient under consideration upon a treadmill under controlled conditions. The apparatus of the invention includes special mounting of video and sound recording apparatus in proximity to a visual observer and the patient with appropriate supporting framework adjustably controlling mounting and utilization of the treadmill in concert with the recording apparatus.

8 Claims, 9 Drawing Figures

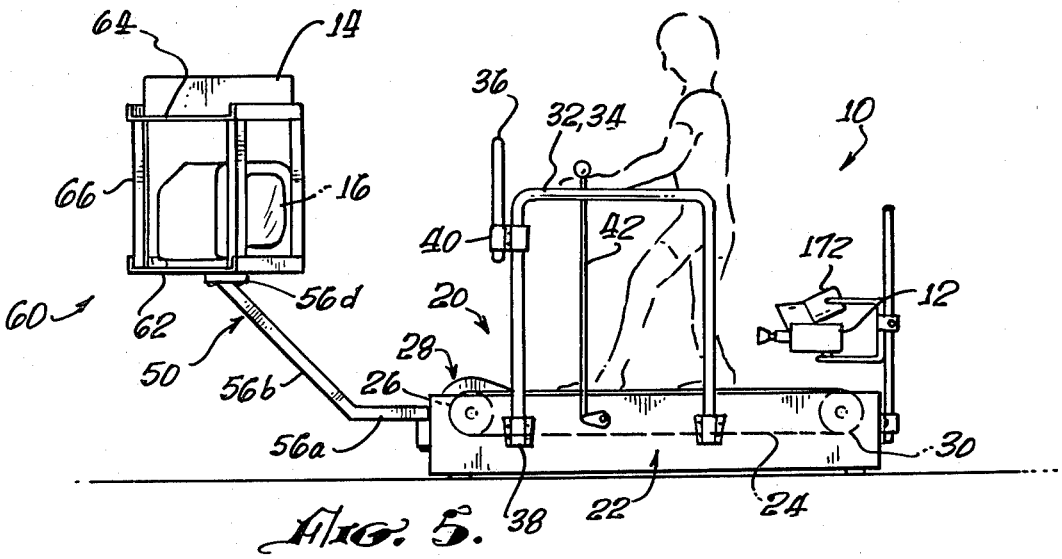
FIG. 5.
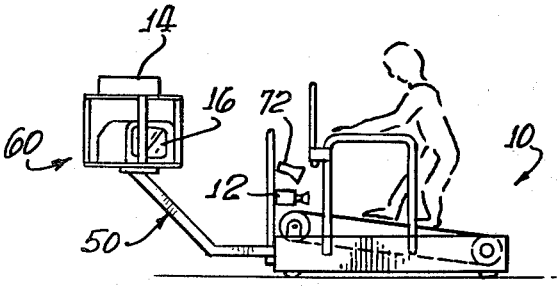
FIG. 6.
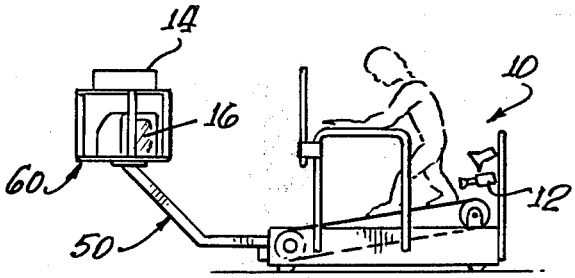
FIG. 7.
FIG. 8.
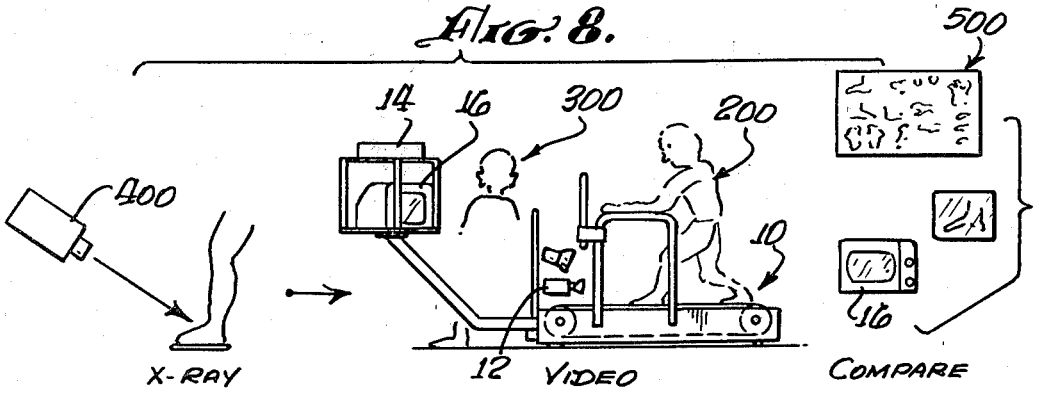
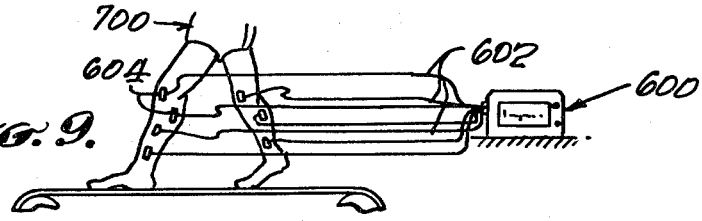
FIG. 9.

METHOD AND APPARATUS FOR RECORDING GAIT ANALYSIS IN PODIATRIC DIAGNOSIS AND TREATMENT

CROSS-REFERENCE TO RELATED PATENT APPLICATIONS

There are no patent applications filed by us related to this application.

BACKGROUND OF THE INVENTION

1. Field of the Invention

This invention is in the general field of diagnostic and treating devices for podiatric cases. The invention is particularly related to observing and recording the gait of a patient while moving along a treadmill. The invention is further specifically directed to a unique method and apparatus for practicing such diagnosis and treatment wherein the information can be recorded and stored for reference should it be needed at a later time.

2. Description of the Prior Art

The prior art, if it can be considered prior art, relating to diagnosis and treatment of podiatric conditions involves only the use of conventional X-ray and fluoroscope apparatus together with some interview and an occasional photographic supplementation.

The prior methods have no relation to, and therefore cannot be considered prior art as applied to the present invention. The present invention is unique in, for the first time, bringing together a specifically mounted video and sound recording of a patient moving upon a controlled treadmill with the angle of observation and recording being such that a unique combination is accomplished. In addition, the apparatus encompasses the use of myographic equipment in conjunction with the video and sound recording in order to obtain proper muscular evaluations.

In this combination there has never before been such a development as the present invention.

THE SUMMARY OF THE INVENTION

Diagnosis and treatment of podiatric problems relating to gait analysis has been extremely difficult because of the complicated nature of such problems.

The large quantity of paperwork necessary to record data from the diagnosis and treatment of such podiatric problems has involved much time from specialized diagnosticians whose time is most valuable for more important matters.

Using the past methods, the patient could not easily be informed of the care and treatment he was receiving nor in what manner he could properly cooperate and react, primarily because of the complexity of reviewing such difficult and un-understandable (to the layman) records obtained during the diagnosis and treatment.

We have studied these problems and are thoroughly familiar with the heretofore existing cumbersome methods of proper recordation of information as well as analysis and application of the analysis to prescribe treatment. We have found that no matter how thorough the prior methods were, that it has been a virtual impossibility to accurately observe, record and apply the conditions, especially over a range of slow walking to rapid running.

Patients have found that it is virtually impossible to repeat the same exercise or conditions under which information may have first been observed or gathered. Thus, a constant reevaluation under changing conditions makes a thoroughly satisfactory analysis most difficult, if possible at all.

We have made many experimentations and have devoted much time to analysis of the problems confronting a practitioner in order to properly diagnose and treat under these conditions. To do this we have devised a method in which we utilize a video and sound recording system together with myographic equipment and personal observation, particularly connected to and utilized in connection with, a totally controllable treadmill. Thus by proper timing all prior conditions are met in each subsequent test.

It is an object of this invention to provide a method and apparatus as heretofore described which can be located wherever desired for treatment and diagnosis.

Another object of this invention is to provide such a method and apparatus which can be easily controlled and used by unskilled persons as well as skilled technicians.

Another object of this invention is to provide such a method and apparatus as has been described which can be adjusted easily to accomodate to any patient from a child to an elderly adult and for recording the gait and associated data under a variety of controlled conditions which can be repeated with complete accuracy.

The foregoing and other objects and advantages will become apparent to those skilled in the art upon reading the description of a preferred embodiment which follows in conjunction with a review of the appended drawings.

BRIEF DESCRIPTION OF THE DRAWINGS

FIG. 5 is a side elevation schematic showing the placement of the camera and lighting equipment toward the rear of the treadmill;

FIGS. 6 and 7 show schematic side elevations of alternate treadmills;

FIG. 8 schematically illustrates a procedure of observation and diagnosis of the patient; and FIG. 9 is a schematic showing of an electromyographic recording of material of the patent's progress along the treadmill.

DESCRIPTION OF A PREFERRED EMBODIMENT

Figures 1, 2:
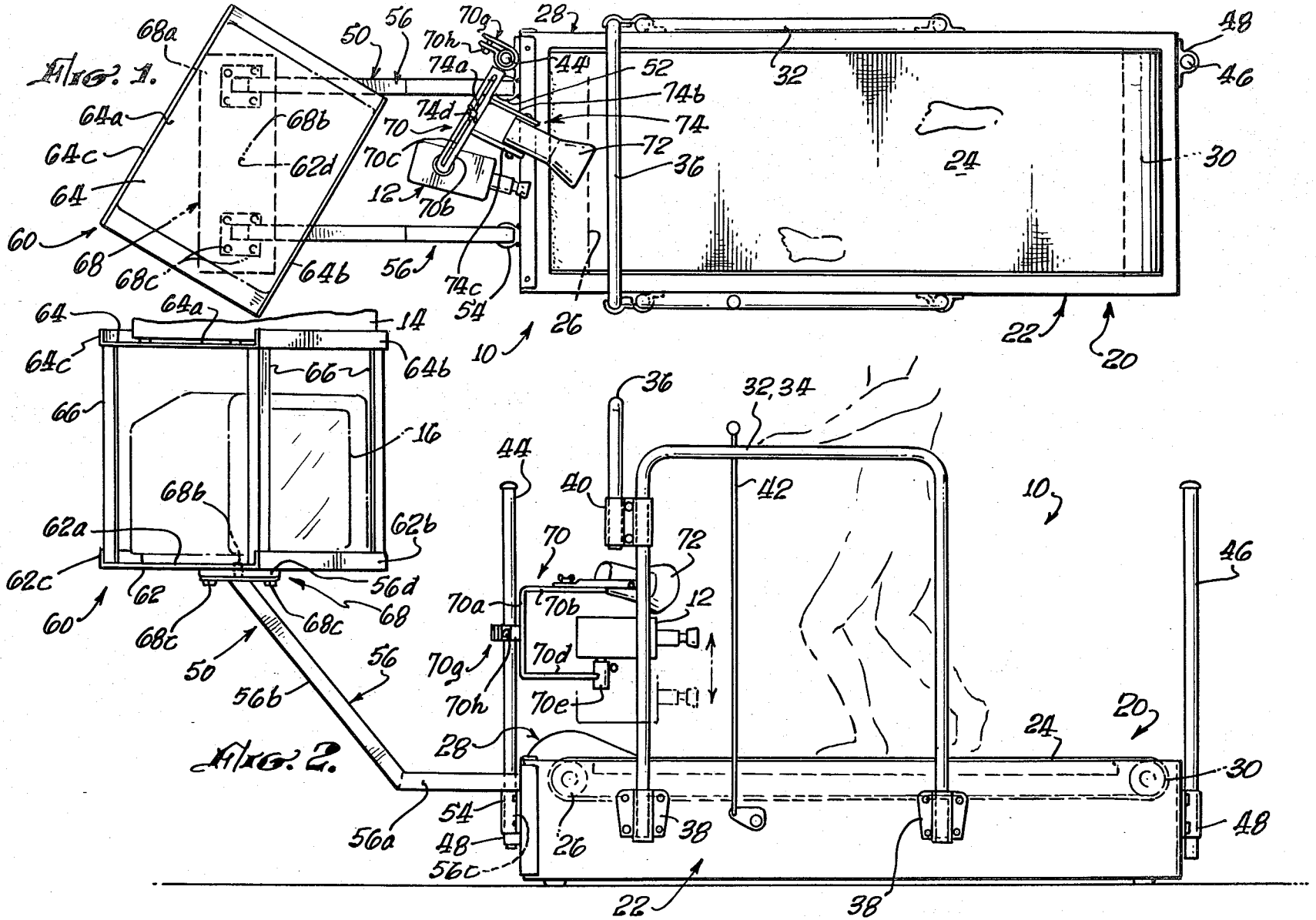
FIG. 1 is a top plan view of a video recording system as it is attached to a conventional treadmill.
FIG. 2 is a side elevation of FIG. 1.

FIGS. 1 and 2 illustrate an assembled video recording apparatus attached to a conventional treadmill structure. The treadmill structure is familiar to persons skilled in such art. The overall assembly of the combined treadmill and related items is designated by the reference numeral 10.

The overall assembly 10 includes a video camera 12, a video recorder 14, a television viewer 16 and a microphone 18.

The treadmill 20 is shown to be comprised of a base 22 supporting a flat belt 24 and passing over drive roller 26. The drive roller is driven by a drive assembly 28, conventional to the art of treadmills, and pulls the belt 24 over an idler roller 30.

Right and left side rails 32 and 34 are mounted to the base 22 along with a front guard rail 36. Brackets 38 are provided for mounting the side rails 32 and 34 to the base and a pair of clamps 40 rigidly fasten the rail member 36 to the right and left side rails 32 and 34.

A control lever 42 passes through the left side rail 34 and is used by the person condicting the movement along the treadmill to be able to control the speed of the treadmill and to turn the drive unit on or off.

Front and rear vertical posts 44 and 46 are fastened by means of brackets 48 to the treadmill base 22. All of these heretofore mentioned elements comprise a conventional treadmill which is generally available on the market.

A support means, generally indicated by the reference numeral 50, is provided for the purpose of attaching and supporting a video tape recorder unit, a television viewing unit, and an electric condenser microphone. The support means 50 includes a pair of tubular members 52 and 54 which are welded to a forward plate of the base 22 of the treadmill. These tubular members support a pair of support arm units 56. Horizontal portions **56*a* are formed integrally with angular portions 56*b* and said horizontal portions have downwardly projecting pins 56*c* affixed thereto. These pins fit into the tubular members 52 and 54. At the upper portion of the angular segments 56*b* of the arms 56 are welded small rectangular plates 56*d***.

Figures 3, 4:
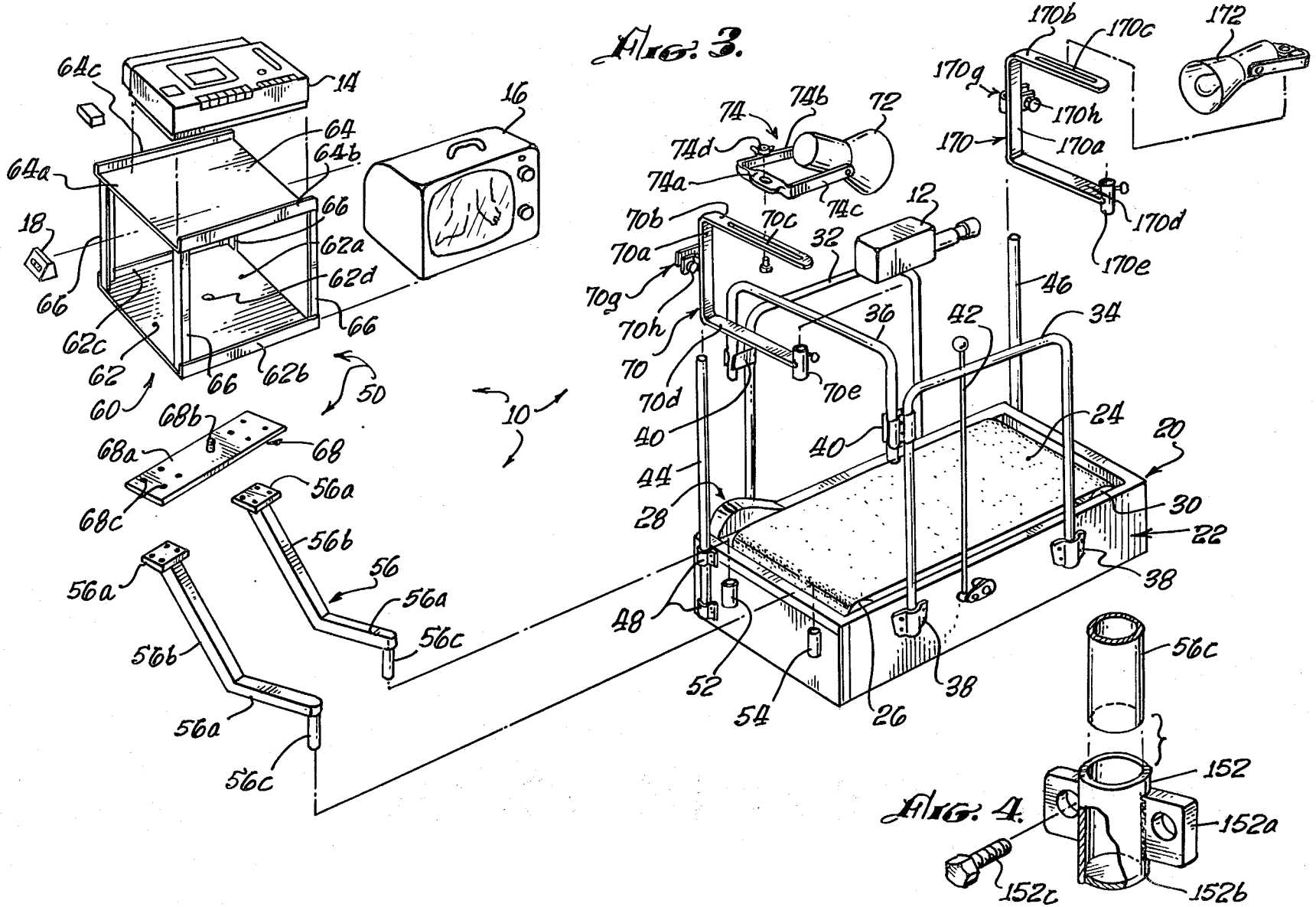
FIG. 3 is an exploded view of all of the components involved in the adaptation of the invention to a conventional treadmill.
FIG. 4 is an exploded view of an alternate method of securing the video recording system components to the treadmill frame.

As shown more clearly in FIG. 3, a support housing 60 which is comprised of a lower platform 62 and an upper platform 64 is provided for the mounting of the television receiver and the video recorder. A base **62*a* having a forward retaining edge 62*b* and a rear retaining edge 62*c* comprises the lower platform construction. An opening 62*d*, located in the center of the base 62*a* is for the purpose of allowing a pivot pin to be inserted as will be described later in this application. The upper support plate 64 comprises a base portion 64*a* having forward edge 64*b* and a retaining edge 64*c* located at its rearward portion. The lower and upper platform 62 and 64 are interconnected by angle iron posts 66**.

A lazy-susan type of support plate 68 is comprised of a rectangular member **68*a* having a pin 68*b* affixed thereto. The plate 68 is mounted to the rectangular plates 56*d* of the arms 56 by means of fasteners 68*c***.

As illustrated in FIG. 3, a U-shaped support bracket 70 having a vertical portion **70*a* turning into upper and lower horizontally disposed extensions 70*b* and 70*d*, is provided. The upper arm 70*b* has a longitudinal slot 70*c* formed therein. This is for the adjustable attachment of a light support assembly. The lower horizontal arm 70*d* has a tubular member 70*e* attached to its outer extremity. A clamp 70*g* is welded or otherwise formed integrally with the vertical arm 70*a* and is provided with a tightening screw 70*h***.

A lamp 72 adjustably mounted to extensions **74*b* and 74*c* which in turn are connected by a portion 74*a* of a bracket 74 may be mounted to the horizontal arm 70*a*. The clamping means 70*g* then is slipped over the forward vertical post 44 and the tightening screw 70*h* secured the overall lamp and video camera mounting bracket at a selected position. A bolt and nut assembly 74*d* is provided to mount the bracket 74 to the support means 70**.

As shown in FIG. 3, a secondary lamp assembly 172 can be mounted on bracket assembly 170. The bracket 170 may, in turn, be slipped over the rear vertical post 44 and adjusted to direct the second lamp for projecting light onto the subject being video taped while progressing on the treadmill assembly. The same bracket 170 can support the video camera in a position to video tape information from another angle.

An alternate embodiment is shown in the fragmentary perspective of FIG. 4 wherein the support arms 56 are retained onto the treadmill base 22 in another fashion. A pair of brackets 152 comprising a central plate **152*a* and having tubular members 152*b* welded thereto are fastened to the forward wall of base 22 by means of bolts 152*c*. This method offers a different way of assembling the whole video recorder and television viewer support assembly by merely providing threaded opening in the front wall of the base 22 and bolting the brackets 152** thereto.

FIG. 5 is a schematic view showing the placement of the camera at the rear of the treadmill for video taping a different angle upon a subject patient.

FIGS. 6 and 7 show schematically treadmills that may be tilted upwardly or downwardly in order to put different stress on the patient's gait to observe different results.

FIG. 8 shows a procedure in which observation and diagnosis can be done systematically. In this figure the person 200 being observed is shown progressing on a treadmill while an observer 300 operates the video camera and recording apparatus. An X-ray camera 400 is used in preliminary documentation of the patient's condition prior to and following the testing and treating procedures. A chart 500 is used to explain to the patient various informative material. The trained observer 300 can in this manner communicate information of the analysis and treatment very clearly to the patient.

FIG. 9 is a showing of a patient's feet progressing along a treadmill having an electromyogram gathering mechanism 600 having leads 602 attached to electrode 604 at various placements on the muscles of the feet of the patient 700.

We claim:

1. A method for recording gait analysis for diagnosis and treatment of podiatric conditions comprising; (1) having a subject whose gait is being analyzed move on a treadmill which is controllable by an operator; (2) Simultaneously recording and displaying a view of the patient's activity under the controlled conditions; (3) recording the diagnosis session by sound recording; (4) altering the conditions of activity of the subject by alteration of the treadmill characteristics; (5) recording by video and sound the effects of the altered treadmill conditions; and (6) analyzing the results comparatively.

2. A method as set forth in claim 1 wherein X-ray films of said subject are used for reference in said podiatric diagnosis and treatment.

3. A method as set forth in claim 2 wherein an illustrated chart means is used in conjunction with said X-ray films.

4. A method of claim 1 wherein in addition to the video and sound recording, myographic data is recorded and analyzed in conjunction with the other analysis set forth.

5. Apparatus for recording gait analysis in podiatric diagnosis and treatment comprising: treadmill means for supporting a subject whose gait is being analyzed, said treadmill means having a normally horizontal attitude; recording means support cooperable with said treadmill means for supporting recording apparatus thereon;

video recording means connected with said support means; sound recording means connected with said support means; video display means displaying video recording as it is recorded; means for altering conditions of operation of the treadmill means; and means for altering the condition of the video recording means in cooperation with any alteration of the conditions of operation of the treadmill means.

6. The apparatus of claim 5 wherein the conditions of alteration of the treadmill means include means to alter the normally horizontal attitude of the treadmill means.

7. The apparatus of claim 6 wherein myographic equipment is associated with the treadmill means, said myographic equipment recording, and records muscle behavior of the subject.

8. An apparatus for audible and visual recording of gait analysis in podiatric diagnosis and treatment which comprises: a treadmill means for supporting a human person; controllable speed means for actuating said treadmill means; integrally connected support means associated with said treadmill means for supporting video camera means; lighting means for said video camera means, integrally connected support means on said treadmill means for supporting said lighting means, said lighting means provided with adjustable means for directing said lighting means toward said human person at the lower portion of his body; visual display means, adjustably mounted to said treadmill means in such manner as to allow both a human person being supported on said treadmill means and an attending observer alongside said human person on said treadmill means to observe the display; and means for audibly recording and transcribing a conversation and other sounds between said observer and said human person on said treadmill means for future diagnosis and treatment.

* * * * *